US010049506B2

(12) United States Patent
Patron et al.

(10) Patent No.: US 10,049,506 B2
(45) Date of Patent: Aug. 14, 2018

(54) DOCUMENTATION OF A MOTOR VEHICLE CONDITION

(71) Applicant: Bayerische Motoren Werke Aktiengesellschaft, Munich (DE)

(72) Inventors: Christian Patron, Munich (DE); Matthias Schindler, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 161 days.

(21) Appl. No.: 15/088,685

(22) Filed: Apr. 1, 2016

(65) Prior Publication Data

US 2016/0292935 A1 Oct. 6, 2016

(30) Foreign Application Priority Data

Apr. 2, 2015 (DE) ..... 10 2015 205 978

(51) Int. Cl.
*G07C 5/00* (2006.01)
*G07C 5/08* (2006.01)

(52) U.S. Cl.
CPC ..... *G07C 5/008* (2013.01); *G07C 5/0866* (2013.01)

(58) Field of Classification Search
None
See application file for complete search history.

(56) References Cited

U.S. PATENT DOCUMENTS 9,317,983 B2 * 4/2016 Ricci ..... H04W 4/046
9,536,254 B1 * 1/2017 David ..... G06Q 30/0278
9,723,251 B2 * 8/2017 Slotky ..... H04N 5/77
2005/0046584 A1 * 3/2005 Breed ..... B60C 11/24 340/13.31
2009/0153312 A1 * 6/2009 Tanaka ..... B60Q 9/00 340/426.1
2009/0160930 A1 * 6/2009 Ruppert ..... G06T 1/0007 348/37
2010/0214411 A1 * 8/2010 Weinmann ..... B64D 45/00 348/148
2013/0261880 A1 * 10/2013 Cho ..... G06F 17/00 701/32.4
2014/0306799 A1 * 10/2014 Ricci ..... B60Q 1/00 340/5.83

(Continued)

FOREIGN PATENT DOCUMENTS

DE 10 2005 058 353 A1 6/2007
DE 10 2008 047 727 A1 3/2010
DE 10 2013 211 005 A1 12/2014

OTHER PUBLICATIONS

German Search Report issued in counterpart German Application No. 10 2015 205 978.2 dated Dec. 9, 2015 with partial English translation (12 pages).

*Primary Examiner* — Reza Aghevli
(74) *Attorney, Agent, or Firm* — Crowell & Moring LLP

(57) ABSTRACT

A system and method are provided to document the condition of a motor vehicle with an image generation device coupled to a control device of the motor vehicle via a data link. An image generation signal is initiated, which is present both at the control device of the motor vehicle and at the image generation device. The image generation signal triggers the generation of an image of the motor vehicle by the image generation device and triggers the generation of a data stamp at the control device. The data stamp is linked to the image.

20 Claims, 4 Drawing Sheets

(56) References Cited

U.S. PATENT DOCUMENTS

2014/0310186 A1* 10/2014 Ricci ..... H04W 48/04
705/302
2014/0347782 A1* 11/2014 Fujita ..... B32B 18/00
361/301.4

* cited by examiner

DOCUMENTATION OF A MOTOR VEHICLE CONDITION

CROSS REFERENCE TO RELATED APPLICATION

This application claims priority under 35 U.S.C. § 119 from German Patent Application No. 10 2015 205 978.2, filed Apr. 2, 2015, the entire disclosure of which is herein expressly incorporated by reference.

BACKGROUND AND SUMMARY OF THE INVENTION

The invention relates to a method, a system, an image generation device and a control device for documenting the condition of a motor vehicle and to a correspondingly equipped motor vehicle.

DE 10 2005 058 353 A1 discloses an apparatus with which the condition of a motor vehicle can be documented. Said apparatus has a turntable, on which the motor vehicle must be arranged. A digital video camera is used to take recordings of the motor vehicle while it is rotated on the turntable. In the process, all the individual recordings and additional data sets that are created for a certain vehicle can be assigned to each other by identification information. The apparatus can be connected to a data network, and the image recording can also be carried out in a remote-controlled manner. Such an apparatus allows the condition of a motor vehicle to be captured in a very precise manner.

However, this known apparatus is very complex and expensive. It is essential for vehicle hire companies that the motor vehicles can be returned at many different locations. If it were desired to use this known apparatus to document a motor vehicle, a recording station of this type with a turntable would have to be installed at every return location, which is not economically feasible.

Car-sharing companies are companies that manage the organized, collective use of one or more motor vehicles. Car-sharing companies of this type are often not-for-profit organizations with a low budget. It is fundamentally not possible for such organizations to provide such a complex station with a turntable.

However, it would be very advantageous for vehicle hire and car-sharing companies if the condition of the motor vehicles operated by the respective companies could be documented regularly.

German patent publication no. DE 10 2013 211 005 A1 discloses a method for transmitting a current condition of a motor vehicle, in which a conventional digital camera is used as the image-capturing device. Preferably, a digital camera provided in a mobile telephone (smartphone) is used. The images captured with the digital camera are transmitted to a computation device on which reference images are provided. The computation device uses the transmitted images to check the current condition of the exterior of the motor vehicle by comparing the transmitted images with the stored reference images. If a digital camera integrated in a smartphone is used, a software module (application) can be executed on the smartphone, which software module gives the user of the smartphone instructions about the position from which and the direction in which said user should photograph the motor vehicle. Such instructions can be displayed by means of arrows on a screen provided on the smartphone.

A method of this type for capturing the condition of a motor vehicle can be carried out cost-effectively at different locations. The investment costs are very low. Nevertheless, damage to the motor vehicle can be clearly ascertained or a damage-free condition of the motor vehicle can also be clearly captured.

The invention is based on the object of developing a method and a system for documenting the condition of a motor vehicle such that the images captured thereby can be used as reliable evidence.

In the method according to the invention for documenting the condition of a motor vehicle with an image generation device, which is coupled to a control device of the motor vehicle by a data link, an image generation signal is initiated, which is present both at the control device of the motor vehicle and at the image generation device. The image generation signal triggers the capturing of an image of a motor vehicle with the image generation device. Furthermore, the image generation signal triggers the generation of a data stamp by the control device of the motor vehicle. The data stamp is linked to the image.

Since the data stamp is generated by the control device of the motor vehicle, it is created independently of the image generation device. The data stamp thus originates from the motor vehicle itself. Images having such a data stamp thus have substantially greater cogency than images without such a data stamp, since said images can only be created with the respective vehicle to be documented.

The data stamp preferably comprises one or more of the following information items:

a time information item that describes the time at which the image was generated, a location information item that describes the location of the motor vehicle during image generation, an information item relating to vehicle-specific parameters, e.g. mileage of the vehicle, vehicle identifier, predefined operating parameters, vehicle registration plate, chassis number, an information item relating to environmental parameters, e.g. temperature, precipitation information, wind speed, camera parameters, such as image resolution of the camera, zoom setting (focal distance), use of flash, location and/or orientation of the camera, a driver information item that describes the last or next-to-last driver and front passenger of the motor vehicle.

The vehicle-specific parameters are used on the one hand to document the driving condition of the vehicle and can be used on the other hand to determine an unambiguous identification of the vehicle. A multiplicity of different vehicle-specific parameters represents a form of fingerprint for the vehicle, which also allows an unambiguous identification of the vehicle at a later point in time.

The image and the data stamp linked with the image form a data unit, which is also referred to below as a stamped image. The stamped image is preferably signed digitally. The digital signature is preferably carried out with an asymmetric, cryptographic method, so that the signature cannot be removed from the stamped image subsequently, and it can also be clearly ascertained from the signature that the data stamp originates from a certain motor vehicle. The stamped image can thereby be assigned unambiguously to a vehicle at any time subsequently.

The image generation signal is preferably initiated by the control device of the motor vehicle. The image generation is thereby controlled exclusively by the control device of the motor vehicle, creating a further security barrier to prevent improperly generated images being used to document the condition of the motor vehicle.

The image generation device can be authenticated with respect to the control device of the motor vehicle. Preferably, an identifier of the image generation device is linked to the respective image. It is also possible for only certain image generation devices to be authorized by the control device to capture the images of the motor vehicle.

Environmental information about the motor vehicle can be captured using sensors, which are provided on the motor vehicle, and linked to the respective image. Such environmental information is e.g. weather data (temperature, precipitation) and/or images of the environment of the motor vehicle, which are captured using cameras arranged on the motor vehicle. Preferably, at the same time as the generation of the image of the image generation device, an image of the environment of the motor vehicle is also captured by a camera arranged on the motor vehicle, the viewing direction of which points in the direction of the image generation device, so it is clearly documented that the image generation device was in the vicinity of the motor vehicle and the viewing direction thereof was pointing at the motor vehicle. This allows a subsequent check as to whether a certain image of the motor vehicle was actually recorded by the image generation device. The environmental information can alternatively also be read out of a database. This is expedient particularly if the motor vehicle is connected to the Internet. The environmental information read out of a database can also be used in addition to the environmental information determined by sensors.

Preferably, route coordinates of the motor vehicle of a route covered immediately leading up to a certain event are linked to the image. The certain event can be the generation of an image of the motor vehicle and/or the ascertainment of an accident. Accidents are detected e.g. with acceleration sensors or impact sound sensors, which are used to set off airbags. The route coordinates can comprise the location coordinates of the motor vehicle along the route covered. The route coordinates can also comprise a combination of location and time coordinates of the route covered. Preferably, the resolution of the route coordinates is more precise, the closer the route is in time and space terms to the certain event.

Such capturing of the route coordinates of the motor vehicle before a certain event allows subsequent provision of unambiguous evidence for an accident, since the route information of the motor vehicle is available. In conjunction with documentation of the condition of the motor vehicle, an expert can subsequently reconstruct an accident process very precisely.

The captured image can also be compared with a reference image in order to ascertain changes and in particular damage to the motor vehicle automatically. Such a comparison with a reference image is known from German patent publication no. DE 10 2013 211 005 A1, for which reason reference is made to said document in full.

The invention also relates to a system for documenting the condition of a motor vehicle with an image generation device, which is coupled to a control device of the motor vehicle by a data link, the image generation device being configured such that, triggered by an image generation signal, an image of the motor vehicle is created with the image generation device, and the control device of the motor vehicle being configured such that, triggered by the image generation signal, a data stamp is generated by the control device, the data stamp being linked to the image.

The image generation signal can be initiated by a user of the image generation device. However, it can also be initiated by the control device of the motor vehicle.

The data link between the image generation device and the control device of the motor vehicle is preferably configured to carry out real-time communication, so the image generation signal is present at the image generation device and the control device of the motor vehicle almost simultaneously.

The data link is preferably a W-LAN data link. However, it can also be another radio data link, such as a Bluetooth data link. In principle, it is also possible to use the Internet as the data link, although real-time communication is generally not possible using the Internet. If the Internet is used as the data link, it is expedient to provide each individual item of data generated or captured with a time stamp both in the image generation device and in the control device, so that the exact sequence of the data generation or data capture can be ascertained subsequently. Another wireless or wired data link can also be used instead of a radio data link.

The resolution of the image to be transmitted or the size of the data stamp to be transmitted can be adjusted depending on the available bandwidth. If the captured images are transmitted to the control device of the motor vehicle and the bandwidth is low, it is possible for only one image with low resolution to be transmitted. On the other hand, if the data stamp that is generated by the control device of the motor vehicle is transmitted to the image generation device in order to be linked to the image there, the amount of data can be limited accordingly and, for example, only a time stamp can be transmitted.

The image generation device can be a digital camera. It can be a camera for still images or individual images or else for video recordings. The image generation device preferably has an interface to a radio data link. The image generation device can be a digital camera for generating two-dimensional images. However, it can also be a camera for generating three-dimensional images, e.g. a stereo camera or a time-of-flight camera.

If a camera for generating three-dimensional images is used, deformations in the vehicle can be clearly documented. This is advantageous particularly if an automatic comparison with a reference image takes place.

The image generation device can also be part of a mobile terminal, such as a smartphone, tablet, smartglasses etc.

The image generation device preferably has a zoom lens and/or a flash device.

Within the scope of the invention, an image generation device for documenting the condition of a motor vehicle can also be specified, which device can be coupled to a control device of the motor vehicle by a data link. The image generation device is configured such that, triggered by an image generation signal, it creates an image of the motor vehicle and outputs data of the image to the motor vehicle in order to link a data stamp created in the motor vehicle by the image generation signal.

Within the scope of the invention, a control device for a motor vehicle can also be specified, which device is configured such that it can be coupled to an image generation device by a data link. Triggered by an image generation signal, by which the image generation device creates an image of the motor vehicle, the control device generates a data stamp for linking the data stamp to the image.

Within the scope of the invention, a motor vehicle can also be specified, which comprises a corresponding control device.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
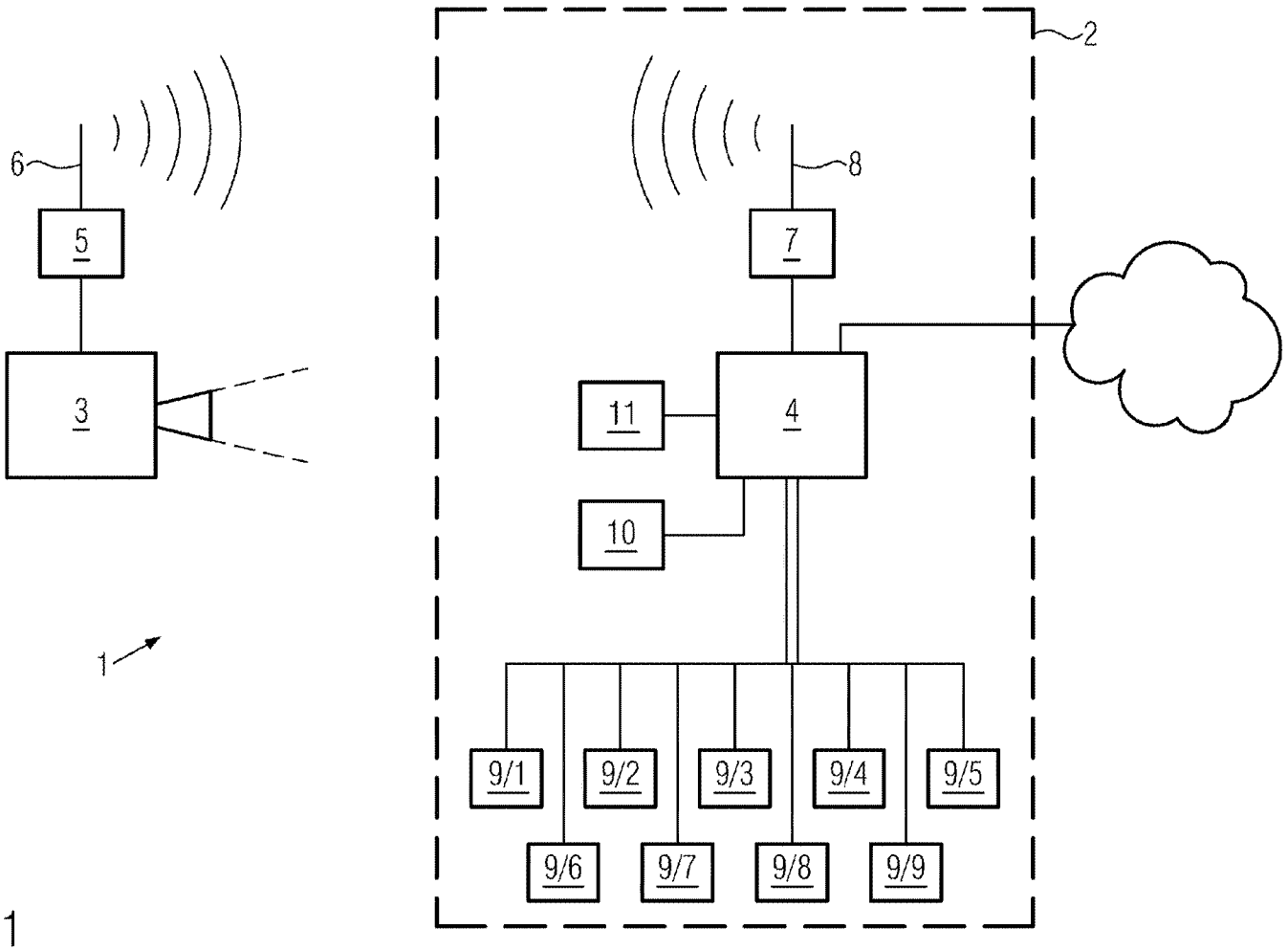
FIG. 1 schematically shows a system for documenting the condition of a motor vehicle in a block diagram in accordance with an embodiment of the present invention.
Figure 2:
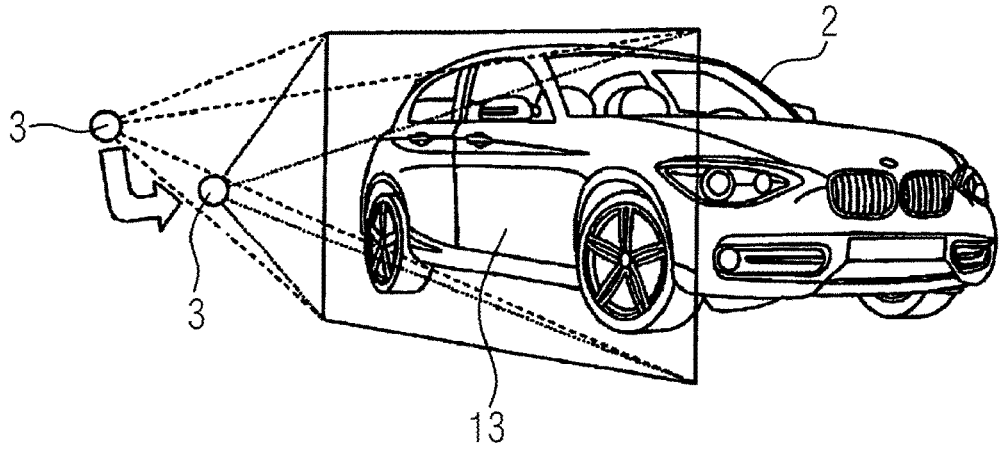
FIG. 2 shows the system of FIG. 1 together with a motor vehicle.

An embodiment of the system 1 according to the invention for documenting the condition of a motor vehicle 2 comprises an image generation device 3 and a control device 4 of the motor vehicle 2.

The image generation device 3 is a digital camera. The digital camera can be configured to generate individual images or still images or else to generate video files. In the present embodiment, the camera is part of a mobile terminal (smartphone, tablet etc.). The image generation device 3 has a radio interface 5 and an antenna 6, via which a bidirectional data link can be established. The data link preferably corresponds to a W-LAN standard. However, it can also be a Bluetooth data link or another standardized data link.

The control device 4 of the motor vehicle is in the form of a processor device with a microprocessor and a data memory device, which comprises a RAM, a ROM and where necessary a hard disk. The hard disk is preferably a solid state drive (SSD), because solid state drives are shock-resistant and allow very fast access to data, which is very advantageous for saving and reading out image data. The control device 4 is mechanically encapsulated, so that the components of the control device 4 are difficult to access from the outside. The control device 4 is preferably configured such that the control device 4 itself is destroyed if the encapsulation of the control device is broken open. This makes it difficult to tamper with the control device 4.

The control device 4 is connected to a radio interface 7, to which an antenna 8 is connected. The radio interface 7 and the antenna 8 are used to establish a data radio link to the image generation device 3 and are configured according to the same radio standard as the radio interface 5 and the antenna 6 of the image generation device 3. The two radio interfaces 5, 7 can thus be used to establish a radio data link that preferably supports real-time operation.

In the motor vehicle 2 are arranged sensors 9, such as a tachometer 9/1, to capture the mileage of the vehicle, a location sensor 9/2, such as a GPS sensor, to capture the location of the motor vehicle 2, a wheel speed sensor 9/3, to capture the speed of one or more wheels of the motor vehicle 2, an acceleration sensor 9/4, an impact sound sensor 9/5 coupled to the body of the motor vehicle 2, a thermometer 9/6, a rain sensor 9/7, one or more cameras 9/8, and further sensors 9/9 for detecting the vehicle condition, such as sensors for detecting the brake pad, the fuel level, the lubricant level etc. Furthermore, the motor vehicle 2 can be equipped with a navigation system 10 and a device 11 for automatically transmitting an emergency call.

A preferred method for documenting the condition of the motor vehicle 2 is explained below with reference to FIG. 3.

The method starts at step S1.

A mobile terminal, on which a program module (application) for documenting the condition of the motor vehicle 2 is stored and executed, is used as the image generation device 3. This program module initiates a radio data link to the control device 4 of the motor vehicle 2 in step S2.

The control device 4 defines which side or which image detail 13 of the motor vehicle 2 should be captured with the image generation device 3 (step S3).

The control device 4 reads in the location coordinates of the motor vehicle 2 from the location sensor 9/2 and calculates the viewing direction with which the image generation device 3 should be pointed at the motor vehicle 2 in order to reproduce the desired part of the motor vehicle (step S4).

The control device transmits the viewing direction to the image generation device 3 (step S5) so that a user can point the image generation device 3 correspondingly at the motor vehicle 1.

Reference images of the motor vehicle 2 can be present in the control device 4. The image generation device 3 is first used to capture images with a low resolution and transmit them to the control device. Said control device compares the transmitted images with the reference image and attempts to align them. Deviations from the viewing direction and the detail 13 actually captured of the motor vehicle are determined. From these deviations, instructions are defined to change the position of the image generation device 3 and/or the focal distance of the image generation device. This information is transmitted to the image generation device 3. Said information can be displayed on the image generation device e.g. in the form of arrows, so that a user can move the image generation device accordingly. If a zoom lens is used, the focal distance can also be adjusted accordingly. With this step (step S6), the image detail 13 to be captured is thus adjusted by the control device 4. Such an adjustment of the image detail 13 is known from German patent publication no. DE 10 2013 211 005 A1, for which reason reference is made to said document in this respect.

If the image detail is correctly adjusted, the control device 4 then generates an image generation signal (step S7), which is transmitted to the image generation device 3. The image generation signal triggers the capture of the image of the motor vehicle with a predefined resolution at the image generation device 3 on the one hand and the generation of a data stamp in the control device 4 on the other hand. The image of the motor vehicle and the data stamp are therefore generated almost simultaneously.

The image generation device 3 transmits the captured image (the image data) to the control device 4 (step S8).

The image and the data stamp that have been triggered by the same image generation signal are linked to each other at the control device 4. The data unit comprising the image and the data stamp is referred to below as the stamped image.

The stamped image is digitally signed by the control device 4 (step S9). This signature is assigned to the motor vehicle 2. This signature cannot be removed from the stamped image again. This digital signature can be used at any time subsequently to ascertain which motor vehicle signed the stamped image. The stamped image can thus be assigned unambiguously to a certain motor vehicle. The time, location and/or driving condition of the motor vehicle are also unambiguously fixed using the information contained in the stamped image.

The information contained in the data stamp comprises:

a time information item that describes the time at which the image was generated, a location information item that describes the location of the motor vehicle during image generation, an information item relating to vehicle-specific parameters, e.g. mileage of the vehicle, vehicle identifier, predefined operating parameters, vehicle registration plate, chassis number, an information item relating to environmental parameters, e.g. temperature, precipitation information, wind speed, camera parameters, such as image resolution of the camera, zoom setting (focal distance), use of flash, location and/or orientation of the camera, a driver information item that describes the last or next-to-last driver and front passenger of the motor vehicle.

To ascertain the information about the driver and front passenger, biometric sensors, which can capture for example a fingerprint or an iris, can be provided in the motor vehicle. A camera provided in the vehicle interior can also be used as a biometric sensor, which captures certain characteristic features of the driver and identifies the respective driver or user of the motor vehicle using a database.

Digital signature methods are known. An asymmetric digital signature method is preferably used, with a private key, which is secret, and a public key.

In step S10, the control device 4 determines whether another part of the motor vehicle should be scanned with the image generation device 3. If this is the case, the method sequence goes back to step S3, in which this further part to be reproduced of the motor vehicle is defined. The following steps S4 to S9 are carried out in the same manner to generate the image, provide it with a data stamp and sign it.

If it is determined in step S10 that no further part of the motor vehicle has to be captured, the method ends at step S11.

Figure 4:
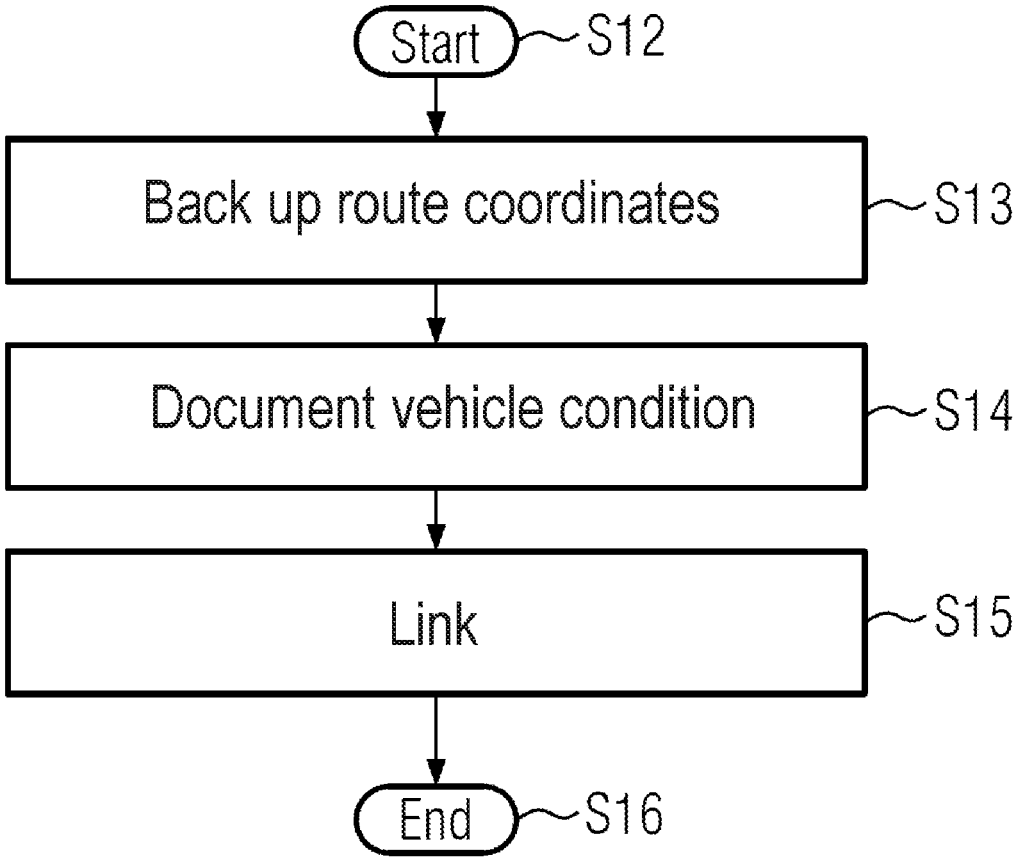
FIG. 4 shows a further method according to an embodiment of the present invention in a block diagram.

FIG. 4 schematically shows a further method that is carried out if a predefined event occurs. The predefined event is e.g. the detection of an accident. An accident can be detected by the acceleration sensor 9/4 and/or the impact sound sensor 9/5. Methods for detecting accidents are known and are used to set off airbags. If an accident is detected with such a method, the method shown in FIG. 4 is automatically started (step S12).

The control device 4 of the motor vehicle 2 is configured such that route coordinates of the route covered by the motor vehicle are captured automatically by the location sensor 9/2. The data are kept in the control device 4 for a predefined time, with route coordinates that are a predefined period or distance away from the current location or the current point in time being first reduced in resolution and then deleted completely. In step S13, the retained route coordinates are backed up, i.e. stored in a memory area in which they are not deleted. The route coordinates can comprise location coordinates. Preferably, they comprise both location coordinates and time coordinates.

Figure 3:
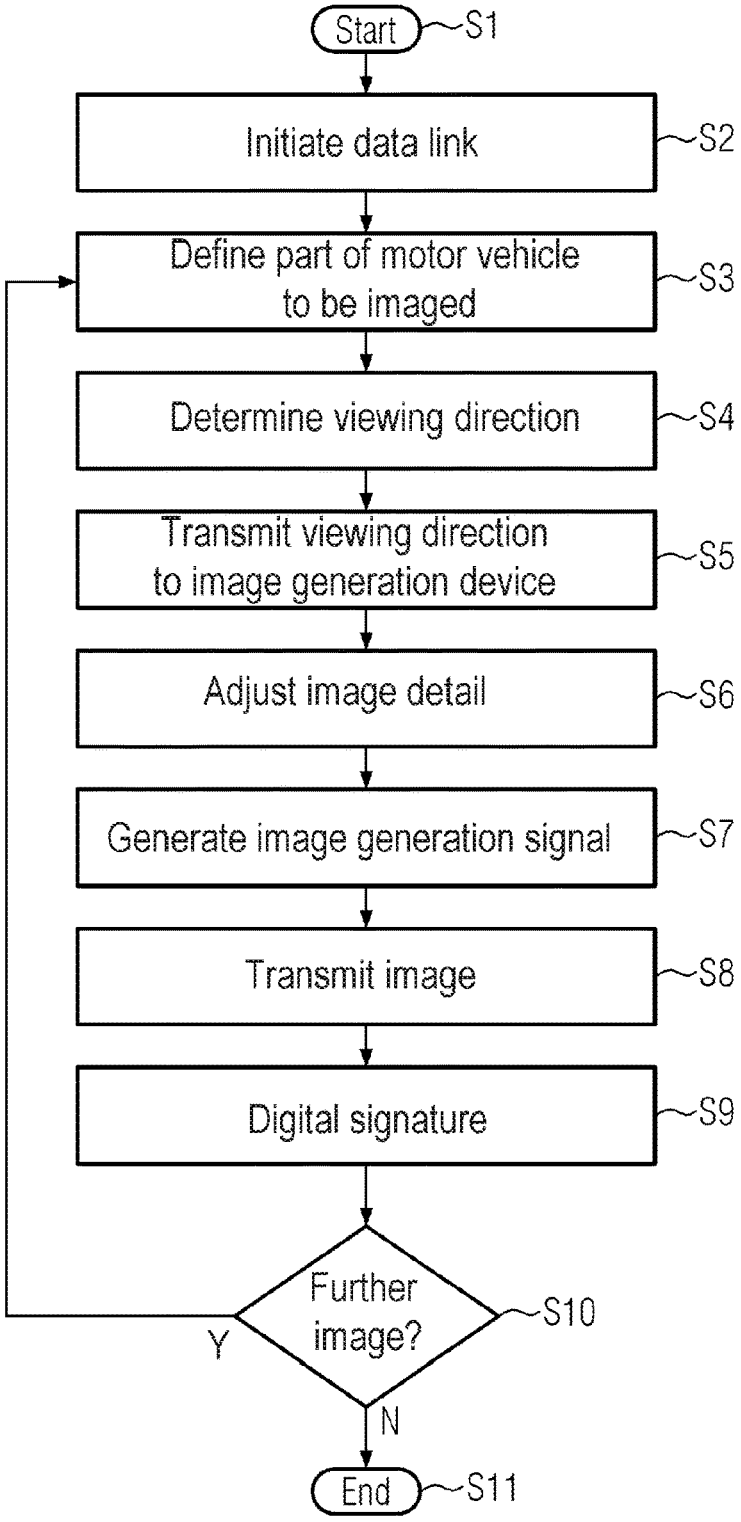
FIG. 3 shows a method according to an embodiment of the present invention in a block diagram.

In step S14, the condition of the motor vehicle is documented, the method shown in FIG. 3 being carried out.

The backed-up route coordinates and the documentation of the condition of the motor vehicle 2 (signed and stamped images) are linked to each other and saved (step S15).

The method ends at step S16.

With this method, the route coordinates from which the driven route of the motor vehicle up to the accident and the speed of the motor vehicle can be derived and also the vehicle condition of the motor vehicle are captured. An expert can reconstruct the accident process very precisely therefrom. The provision of evidence in a legal dispute relating to a motor vehicle accident is made considerably easier thereby.

The method shown in FIG. 3 can also be modified to the effect that the route coordinates are backed up with the documentation of the condition of the motor vehicle every time, even if no accident is detected. The back-up of the route coordinates can also optionally be carried out manually by the user of the image generation device 3.

The methods explained above are advantageous mainly for users of hire cars or of motor vehicles operated in car-sharing schemes, because they can clearly document the condition of the motor vehicle when said motor vehicle is returned. Large investments are not necessary to carry out the method. All that is needed is a program module on a mobile terminal that has a digital camera and corresponding control software in the control device of the motor vehicle. Most of the sensors are present both in the mobile terminal and in the motor vehicle.

If there is no location sensor in the motor vehicle 2, then a location sensor present in the mobile terminal can also be used to capture the location when the image of the motor vehicle 2 is generated.

Smartglasses can also be used as the mobile terminal.

In principle, it is advantageous if the image of the motor vehicle 2 that is generated with the image generation device 3 is loaded onto the control device 4 of the motor vehicle 2 immediately after generation of said image, in order to be provided with the data stamp and preferably signed with the signature of the motor vehicle promptly. A signature of the respective user of the motor vehicle can also be used instead of a signature of the motor vehicle.

Furthermore, the control device 4 can be connected to the Internet 12, in order to save and back up the stamped images on a predefined server.

In summary, the following can be stated:

The condition of a motor vehicle is documented with an image generation device, which is coupled to a control device of the motor vehicle by means of a data link. An image generation signal is initiated, which is present both at the control device of the motor vehicle and at the image generation device. The image generation signal triggers the generation of an image of the motor vehicle by the image generation device and the generation of a data stamp at the control device. The data stamp is linked to the image.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE SYMBOLS

1 System
2 Motor vehicle
3 Image generation device
4 Control device
5 Radio interface
6 Antenna
7 Radio interface
8 Antenna
9 Sensor
10 Navigation system
11 Device for emergency call
12 Internet
13 Part of motor vehicle

What is claimed is:

1. A method for documenting the condition of a motor vehicle, comprising the acts of:

transmitting an image generating signal via a data link to an image generation device;

generating an image of the motor vehicle with the image generating device in response to receipt of the image generating signal;

generating a data stamp associated with the image of the motor vehicle by a control device of the motor vehicle;

linking the data stamp and the image of the motor vehicle by the control device.

2. The method as claimed in claim 1, wherein the data stamp includes at least one of a time information item identifying a time at which the image was generated, a location information item identifying a location of the motor vehicle during image generation, a vehicle-specific parameter information item identifying at least one vehicle-specific parameter, an environmental parameter information item identifying at least one environmental parameter, a camera parameter information item identifying at least one camera parameter, and a driver information item identifying a previous driver of the motor vehicle.

3. The method as claimed in claim 2, wherein the at least one vehicle-specific parameter includes at least one of a mileage of the vehicle, a vehicle identifier, a predefined operating parameters, a vehicle registration plate, and a chassis number, the at least one environmental parameter includes at least one of environmental temperature, precipitation, and wind speed, and the at least one camera parameter includes at least one of an image resolution of the camera, a focal distance setting, an indication of whether a flash was used during the generating of the image of the motor vehicle, a camera location and a camera orientation.

4. The method as claimed in claim 3, wherein the image and the data stamp linked to the image form a stamped image data unit, and the stamped image is digitally signed.

5. The method as claimed in claim 1, wherein the image generation signal is generated by the control device of the motor vehicle.

6. The method as claimed in claim 5, further comprising the act of:

authenticating the image generation device to the control device of the motor vehicle.

7. The method as claimed in claim 6, further comprising the act of:

linking an identifier of the image generation device to the image of the motor vehicle.

8. The method as claimed in claim 2, wherein the environmental parameter information item is obtained from at least one sensor of the motor vehicle.

9. The method as claimed in claim 2, wherein the data stamp includes route coordinates of the motor vehicle identifying a route covered by the motor vehicle prior to an occurrence of a predefined event.

10. The method as claimed in claim 9, wherein the route coordinates included in the data stamp increase in resolution precision the closer the route coordinates are to at least one of a time and a location of the occurrence of the predefined event.

11. A system for documenting the condition of a motor vehicle, comprising:

an image generation device; and a control device of the motor vehicle;

wherein the control device and the image generation device are configured to communicate via a data link, the image generating device is configured to generate an image of the motor vehicle upon receipt of an image generation signal, and the control device of the motor vehicle is configured to generate a data stamp a data stamp associated with the image of the motor vehicle and to link the data stamp to the image of the motor vehicle.

12. The system as claimed in claim 11, wherein the data link is configured to provide real-time communication between the image generating device and the control device of the motor vehicle.

13. The system as claimed in claim 12, wherein the data link is a radio data link.

14. The system as claimed in claim 11, wherein the image generation device is part of a mobile terminal, such as a smartphone, tablet or smartglasses.

15. The system as claimed in one of claim 14, wherein the mobile terminal includes a digital camera and is a smartphone, a tablet or smartglasses.

16. The system as claimed in claim 11, wherein the control device is connected to at least one vehicle sensor of a tachometer, a location sensor, a wheel speed sensor, an acceleration sensor, an impact sound sensor, a thermometer, a rain sensor, a camera, a driving condition sensor, and an air pressure sensor.

17. The system as claimed in claim 11, wherein the control device is connected to at least one of a navigation system and a device for transmitting an emergency call.

18. A condition documenting image generation device of a motor vehicle, comprising:

an image generator;

a communication section; and a control device of the motor vehicle; wherein the communication section is configured to receive an image generation signal, the image generator is configured to generate an image of the motor vehicle in response to receipt of the image generation signal by the communications section; and the communication section is configured to transmit information associated with the image of the motor vehicle generated by the image generator via a data link to the control device.

19. A control device for a motor vehicle, comprising:

a control unit of the motor vehicle configured to communicate with an image generation device via a data link, generate a data stamp associated with an image of the motor vehicle received from the image generating device generated in response to an image generation signal;

receive via the data link the image of the motor vehicle generated by the image generation device; and link the data stamp to the image of the motor vehicle.

20. A motor vehicle comprising the control device as claimed in claim 19.

* * * * *